United States Patent [19]

Hartbauer et al.

[11] 4,106,684

[45] Aug. 15, 1978

[54] SHEET MATERIAL DISPENSING DEVICE

[75] Inventors: Ellsworth A. Hartbauer, Concord; Rudolf R. Weis, Antioch; Horace N. Kemp, Walnut Creek, all of Calif.

[73] Assignee: Crown Zellerbach Corporation, San Francisco, Calif.

[21] Appl. No.: 828,000

[22] Filed: Aug. 26, 1977

[51] Int. Cl.[2] ..... B65H 17/42

[52] U.S. Cl. ..... 226/91; 226/110; 226/127; 242/55.3

[58] Field of Search ..... 226/91, 109, 110, 127; 242/55.3, 55.42

[56] References Cited

U.S. PATENT DOCUMENTS

| | | | |
|---|---|---|---|
| 3,294,329 | 12/1966 | Tucker | 242/55.3 |
| 3,628,743 | 12/1971 | Bastian | 242/55.3 |
| 4,010,909 | 3/1977 | Bastian | 226/91 X |

*Primary Examiner*—Richard A. Schacher
*Attorney, Agent, or Firm*—Thomas R. Lampe

[57] ABSTRACT

A dispensing device for sequentially dispensing sheet material such as paper toweling from a primary roll and a reserve roll, the primary roll initially being rotatably mounted at a first location and adapted to be displaced therefrom to a second location. Sheet material feed means is provided for dispensing the sheet material from the device. Sensing means is provided for sensing displacement of the primary roll from the first location and transfer means is employed in operative association with the sensing means and responsive to the sensing of the displacement of the primary roll from the first location to place sheet material from the reserve roll into operative engagement with the sheet material feed means. The transfer means includes metering means for metering sheet material removed from the primary roll by the feed means after displacement thereof has been sensed by the sensing means, said transfer means being responsive to the metering of a length of sheet material having been removed from the primary roll before placing the sheet material from the reserve roll into operative communication with the sheet material feed means.

3 Claims, 13 Drawing Figures

SHEET MATERIAL DISPENSING DEVICE

FIELD OF THE INVENTION

This invention relates to a device for dispensing sheet material such as paper toweling or the like, and in particular, to a dispensing device for sequentially dispensing such material from a primary roll and a reverse roll.

DESCRIPTION OF THE PRIOR ART

The prior art sets forth a number of arrangements for dispensing paper towels and the like, and includes a number of mechanisms aimed at sequentially dispensing a primary roll and one or more reserve rolls.

U.S. Pat. No. 3,628,743 is illustrative of one prior art approach for sequentially dispensing sheet material from a plurality of sheet material rolls. In the cabinet disclosed in that patent, a mechanism is employed which monitors the diameter of a primary roll of sheet material and when the diameter decreases to a predetermined level, the material of a reserve roll is introduced into the dispenser feed mechanism. In the arrangement shown in the foregoing patent, a partially depleted roll must be manually moved between roll mounting stations to make room for a new reserve roll. Another inconvenience resides in the fact that the lead end of the reserve roll must be physically impaled by the attendant on a prong associated with the transfer mechanism to effect reliable transfer. Inattentiveness on the part of the attendant can result in failure to transfer.

Another prior art approach to the automatic transfer of feed of paper toweling from a primary roll and from a reserve roll is illustrated in U.S. Pat. No. 3,917,191, wherein the transfer mechanism is operative when tension of the web from the primary roll to the feed mechanism decreases or terminates. It will be appreciated that reliance on tensioning of a web and changes therein to effect transfer is an unsatisfactory arrangement especially in the case of paper towels, since a somewhat precarious balance must be maintained between the point where the towel is tensioned too much, and consequently breaks, and that wherein insufficient tension is maintained, thus bringing the transfer mechanism into play prematurely. Again, the attendant must manually move a partially depleted roll between mounting stations to make room for a new reserve roll.

SUMMARY OF THE INVENTION

In accordance with the present invention an improved dispensing device for multi-roll towels or the like is provided. The device includes feed means for dispensing the sheet material from the device and automatic transfer means for introducing the lead end of a reserve roll into operative engagement with the sheet material feed means upon substantial depletion of the primary roll. In accordance with the present invention, sensing means is provided which senses displacement of the primary roll from its normal operative location in the device. When displacement is sensed, metering means included in the transfer means meters sheet material dispensed from the primary roll after displacement thereof, the transfer means being responsive to a length of sheet material removed from the primary roll being metered before placing the sheet material from the reserve roll into operative engagement with the sheet material feed means. The dispensing device additionally comprises manually operable means operatively associated with the sheet material feed means to dispense incremental substantially uniform lengths of sheet material upon manipulation of the manually operable means. Metering is accomplished by an accumulator mechanism actuated by the manually operable means upon manipulation thereof to count the number of times the manually operable means is manipulated, the transfer means adapted to place the sheet material from the reserve roll into operative engagement with the sheet material feed means when a predetermined total number of incremental lengths of sheet material are dispensed.

DESCRIPTION OF THE PREFERRED EMBODIMENT

Figure 1:
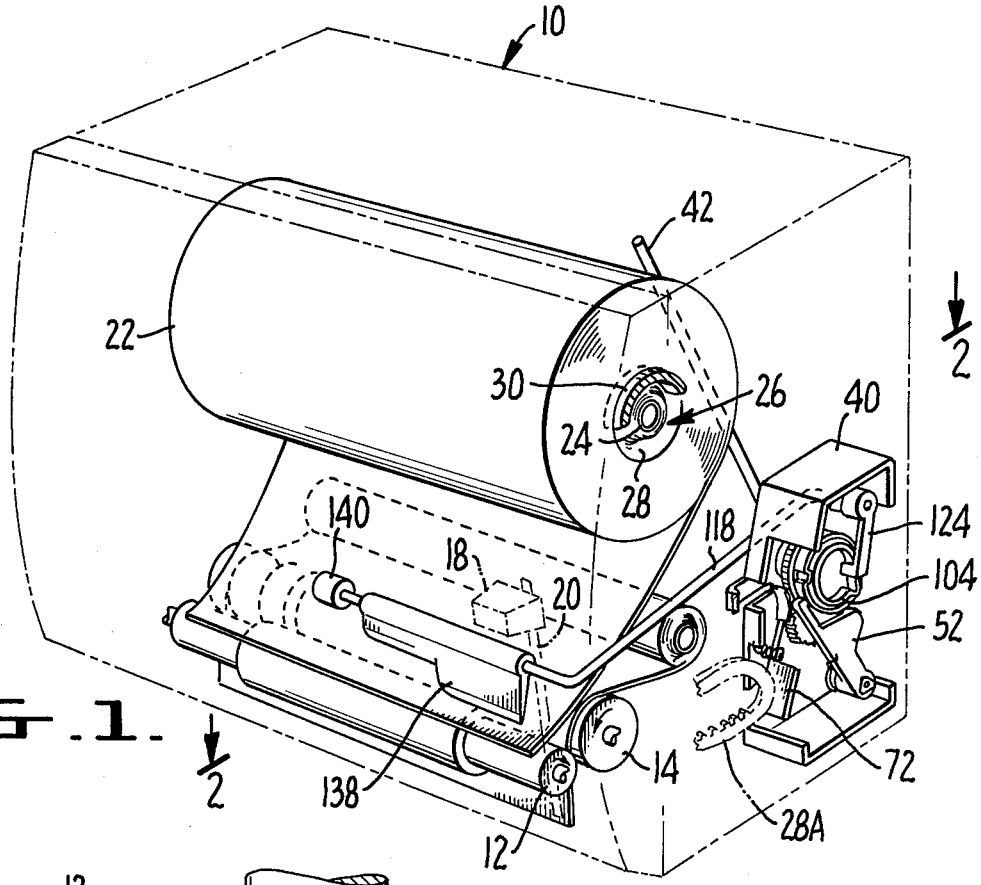
FIG. 1 is a perspective view of a device constructed in accordance with the teachings of the present invention, with the outer housing of the device being shown in phantom.
Figure 2:
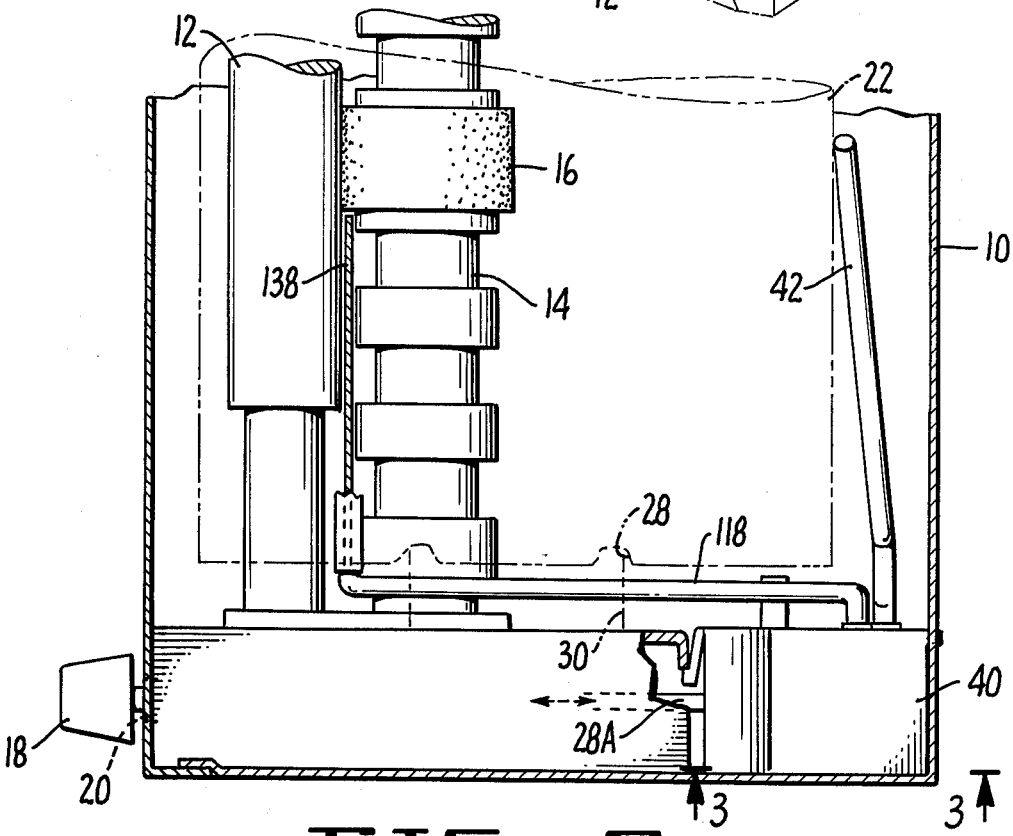
FIG. 2 is a sectional view taken along line 2—2 of FIG. 1.

Referring now to FIG. 1, a device constructed in accordance with the teachings of the present invention is illustrated. The operating mechanism of the device is preferably suitably disposed in a cabinet housing which in FIG. 1 is designated by reference numeral 10 and is illustrated in phantom so that the operating components of the invention may be clearly seen. The device includes sheet material feed means for dispensing sheet material from the cabinet, said sheet material feed means in the illustrated preferred embodiment being a pair of rollers 12 and 14 which are selectively rotatable and form a nip through which the sheet material is drawn upon rotation of the rollers in a well-known manner. The rollers are journaled at the ends thereof in suitable sockets (not shown) disposed at the ends of the cabinet housing. If desired, a resilient sleeve, such as rubber, may be disposed over all or portions of the lengths of either one or both rollers, as for example sleeve 16 (FIG. 2) to improve the grip that the rollers apply to the sheet material upon rotation thereof.

Any suitable mechanism may be employed to effect rotation of the rollers 12 and 14. As a consequence, such mechanism has not been illustrated. One such suitable mechanism is described in U.S. Pat. No. 3,606,125 and reference may be had to that patent for details of a suitable mechanism for rotating sheet material feed means of the roller type. As will be noted with reference to that patent, incremental lengths of toweling are dispensed upon manual actuation of a handle projecting through a slot in the front of a dispenser housing. Such a handle is illustrated in FIG. 1 in phantom and is designated by means of reference numeral 18. It will be appreciated that depression of the handle 18 by the operator will cause a corresponding rotation of rollers 12 and 14. The handle projects through a vertical slot 20 in the front of the cabinet, said slot guiding the movement of the handle and its associated structure and the lower limit thereof determining the extent to which the handle is depressed, and consequently the degree of rotation of rollers 12 and 14. With each depression of the handle a substantially uniform incremental length of toweling will be dispensed.

Rotatably mounted within housing 10 is a roll of sheet material in the form of paper toweling 22. The particular roll 22 illustrated is of the type shown in U.S. Pat. No. 3,038,598, being wound about a core 24 and having a bearing receptacle 26 formed in one extremity of the roll 22 by cutting away the paper adjacent the core 24 to define a bearing wall 28 constituted by contiguous layers of the paper toweling forming the roll. A bearing member 30, of the type for example illustrated in U.S. Pat. No. 3,073,541, is mounted on the sidewall of the dispenser housing 10 and projects inwardly into bearing receptacle 26 to rotatably support the paper towel roll 22 at a predetermined location within housing 10. It will be appreciated that the other end of roll 22 is supported by a suitable bearing mechanism positioned at the other side of the housing 10. Such bearing has not been shown for purposes of simplification and reference may be had to the aforementioned U.S. Pat. No. 3,073,541 for a suitable structure of this type. It will be appreciated that the afore-described roll construction and support bearing construction will result in the automatic dismounting or displacement of the roll from its associated support bearings when enough paper toweling has been removed from the roll for the bearing wall 28 to disappear. The partial roll will then fall downwardly into the bottom area of the dispenser cabinet housing 10, thus enabling a new roll of toweling to be installed in operative relationship with bearing member 30.

It will be appreciated that the foregoing structure per se is known in the art as exemplified by U.S. Pat. Nos. 3,038,598 and 3,073,541. A method of automatically dismounting rolled sheet material as afore-described is also prior art and is taught in U.S. Pat. No. 3,089,659. The following description pertains to new structure for effecting automatic roll transfer upon depletion of the stub roll after it has fallen to the bottom of the cabinet housing to a new full roll which has been mounted by an attendant on bearing member 30. It will be appreciated that without an automatic transfer mechanism the attendant will be required to manually start the end of the new roll in the feed roller nip regardless of whether or not all of the paper toweling on the stub roll has been used up. Such an approach often results in waste of paper towels since it is not uncommon for the attendant to remove the stub roll from the cabinet when threading the new roll when substantial paper toweling still remains on the stub roll core. On the other hand, an attendant starting the new roll may leave the stub roll threaded through the feed roller nip thus resulting in double dispensing of paper toweling, similarly a waste.

Disposed in housing 10 and fastened thereto in any desired fashion is a support member 40 which may be made of molded plastic or the like. Preferably, support member 40 is positioned in the cabinet housing toward the rear thereof and behind the drive mechanism (now shown) associated with rollers 12 and 14. This positioning may best be seen with reference to FIGS. 1 and 2 while FIGS. 3 through 8 set forth with particular clarity details of the operative components and their structural interrelationship. Together, such components comprise means for sensing displacement of the primary roll from its location on bearing member 30 and its companion bearing member as well as transfer means in operative association with the sensing means and responsive to the sensing of the displacement of the primary roll from the aforesaid location by the sensing means to place sheet material from the reserve roll into operative engagement with the sheet material feed means comprising rollers 12 and 14. Specifically, sensing means in the form of a sensing arm 42 is movably connected to support member 40 and extends upwardly and slightly outwardly therefrom so that it is adapted to ride on roll of toweling 22 in the manner illustrated in FIG. 1. The lower portion 42A of the arm 42 is bent at a substantially right angle and passes into the interior of a bearing element 44 which is secured to support member 40. The arm 42 is rotatably mounted in bearing element 44. Integrally connected to sensing arm 42 and passing into support member 40 through a slot 46 formed therein is an activator pin 48. Positioned over bearing element 44 is the socket portion 50 of follower member 52. A spring 54 is disposed about socket portion 50 in the manner illustrated with one leg 56 of the spring in engagement with follower member 52 and the other leg 58 thereof disposed about activator pin 48. As viewed in FIGS. 3, 7 and 8, the spring 54, because its legs 56 and 58 are tensioned when placed over their respective elements 52 and 48, serves to urge follower member 52 in a clockwise position and sensing arm 42 in a counterclockwise position about their common pivot. Any suitable fastener such as sheet metal clip 60 is positioned over the lower end of sensing arm 42 to maintain spring 54 and follower member 52 in position on bearing element 44.

Spaced from bearing element 44 and affixed to support member 40 is a mounting element 62 integrally comprised of circular bearings 64 and 66 and pin 68. A trigger element 72 is rotatably mounted on circular bearing 64 with the bearing projecting into aperture 74 of the trigger element. A slot 76 is formed in trigger element 72 and a boss 78 projecting from support member 40 enters the slot when the trigger element 72 is mounted on circular bearing 64. Thus, the degree of rotation of the trigger element 72 is limited by the extent of movement of boss 78 within slot 76. A spring 80 affixed at one end thereof to support member 40 is secured to trigger element 72 in any desired manner so that trigger element 72 is biased in a clockwise direction about circular bearing 64 at all times.

Positioned in engagement with trigger element 72 and rotatably mounted on circular bearing 66 is a circular ratchet 82 having a plurality of teeth 84 formed about the outer periphery thereof in the manner shown. When ratchet 82 is positioned on circular bearing 66 it is normally engaged by a spring steel pawl 86 that is secured to trigger element 72 by pins 88 projecting outwardly from the trigger element. A small gear 90 is fixedly secured to the face of ratchet 82 disposed away from trigger element 72 and pin 68 projects through a central aperture disposed in the gear 90.

Gear 90 meshes with a gear 92 of larger diameter which is rotatably mounted in a bearing element 94 positioned above mounting element 62. A projection 96 integrally connected to gear 92 is rotatably seated within the bearing element 94 to provide for said rotatable mounting. Integrally connected to the face of gear 92 opposed to projection 96 is a circular cam element 98 having a smooth circular outer cam surface interrupted by a depression 100. It should be noted that when gear 92 is installed in position in engagement with gear 90, the outer surface of the cam element 98 is in alignment with the upper portion of follower member 52 as may best be seen with reference to FIG. 7. The follower member 52 has a reduced end portion 102 adapted to ride directly on the outer surface of cam element 98 and the reduced end portion is of such a size that it may enter depression 100 when in alignment therewith.

Figures 3, 4:
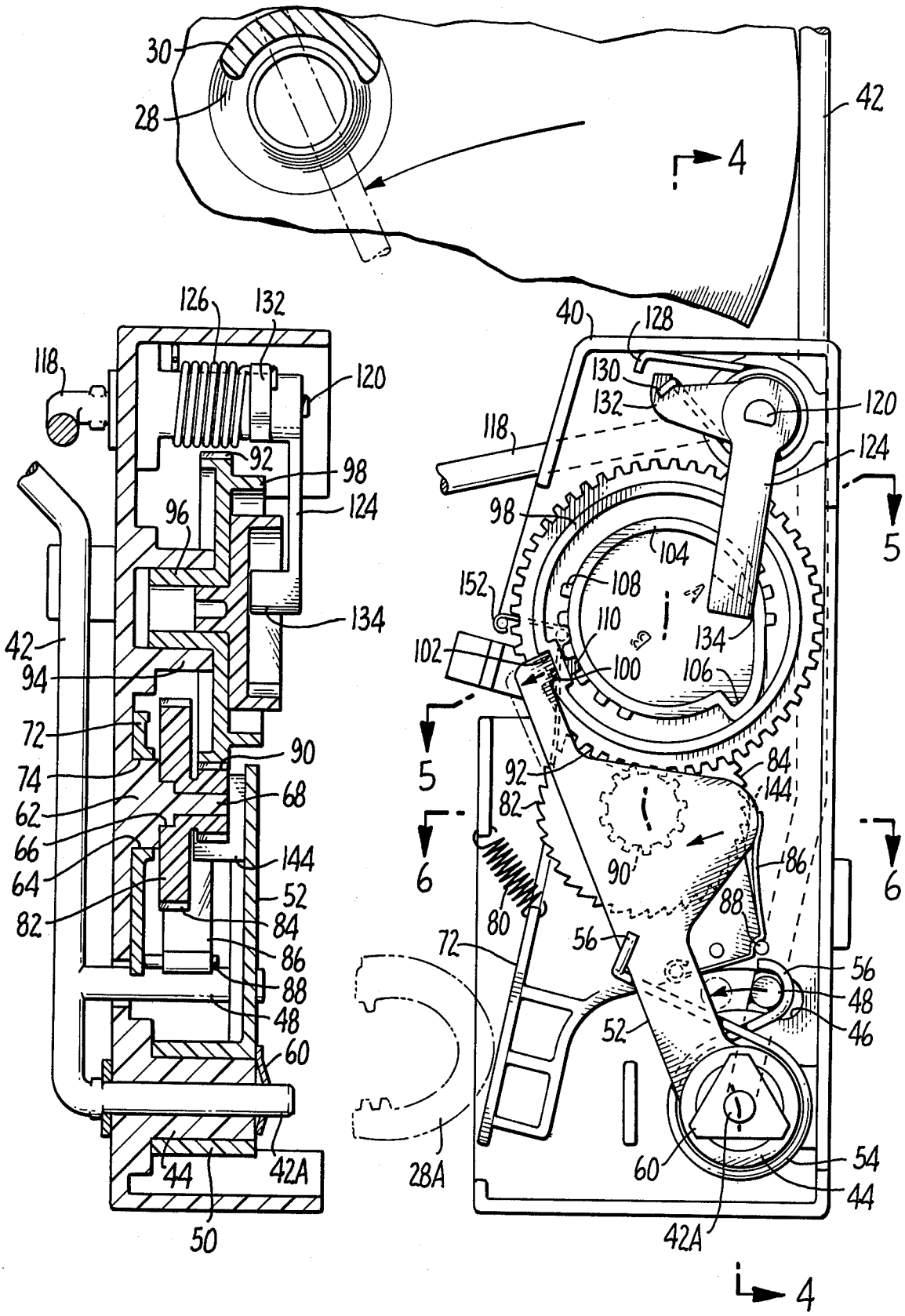
FIG. 3 is a sectional view taken along line 3—3 of FIG. 2.
FIG. 4 is a sectional view taken along line 4—4 of FIG. 3.
Figures 8, 13:
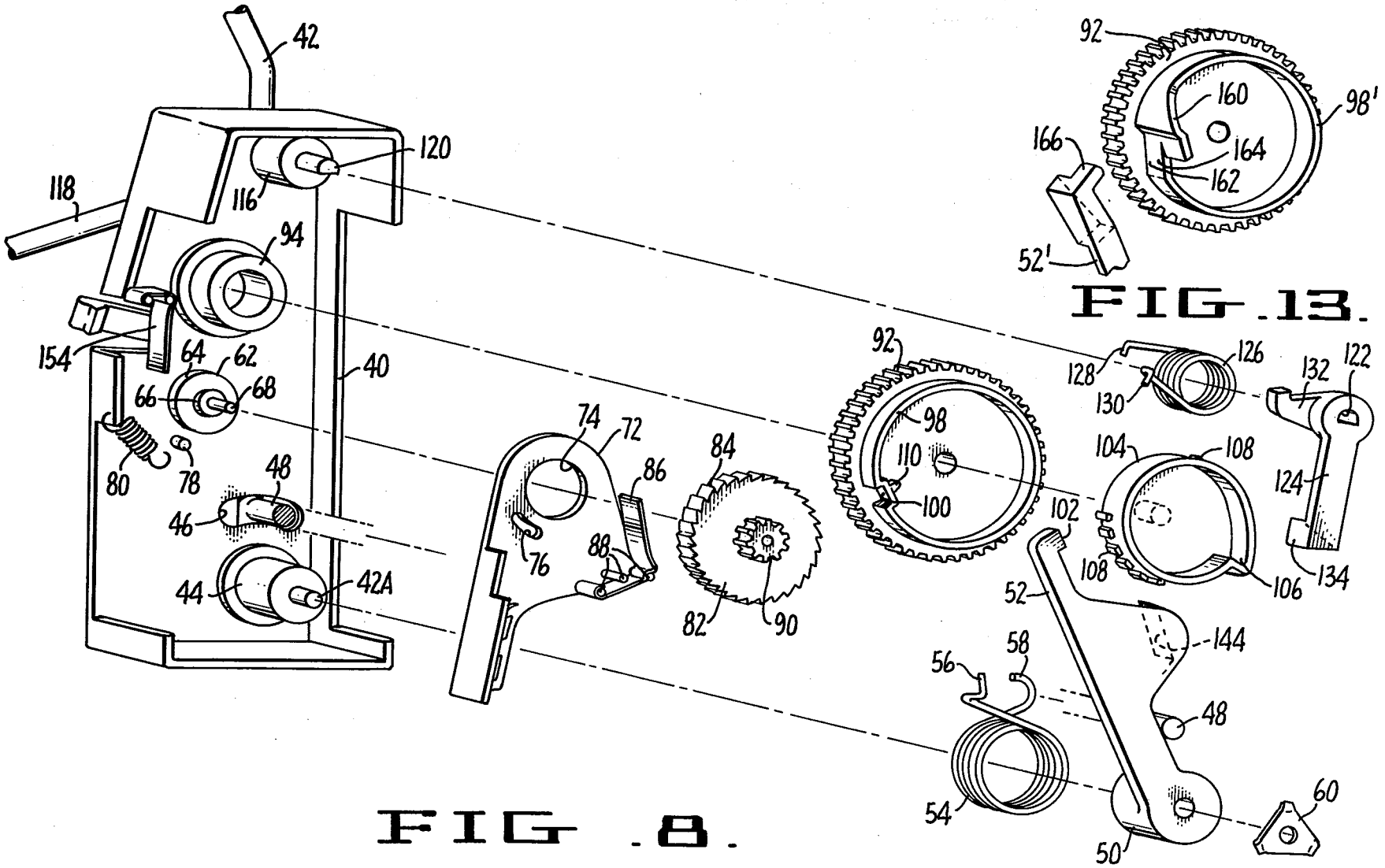
FIG. 8 is an exploded perspective view illustrating the components of the transfer means.
FIG. 13 is a perspective view illustrating an alternative form of follower member - cam element combination that may be employed in the device of the present invention.
Figure 5:
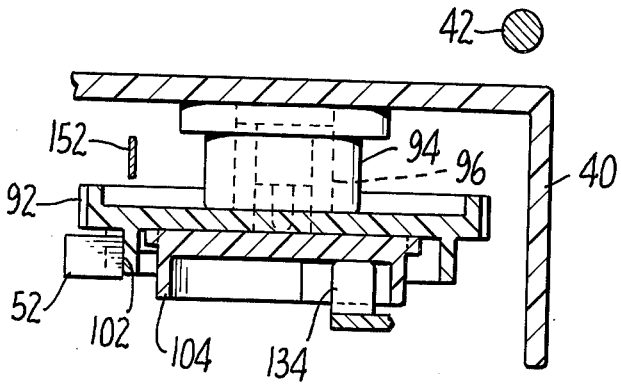
FIG. 5 is a sectional view taken along line 5—5 of FIG. 3.
Figure 6:
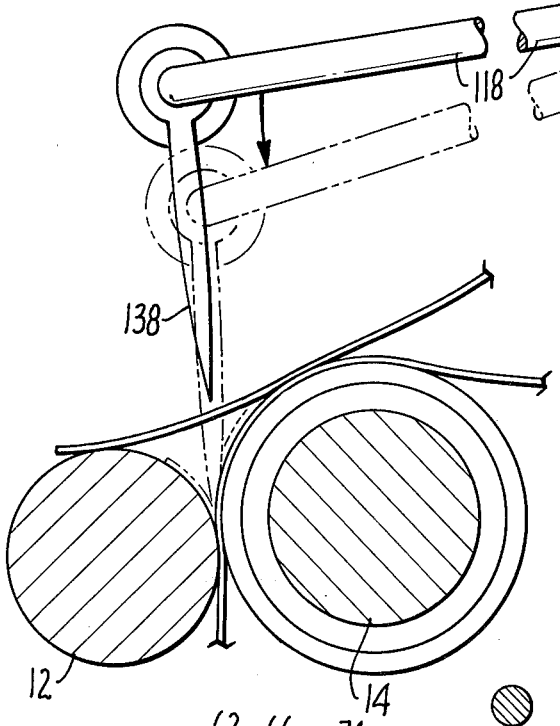
FIG. 6 is a sectional view taken along line 6—6 of FIG. 3.
Figure 6:
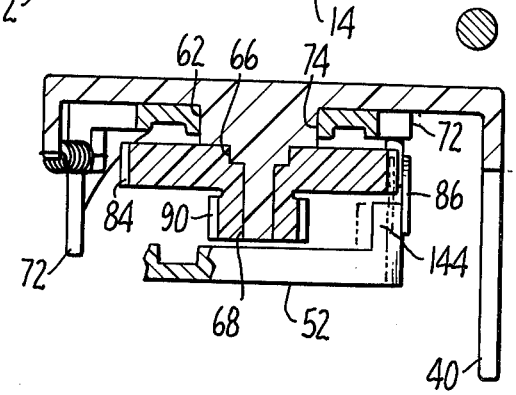
Figure 7:
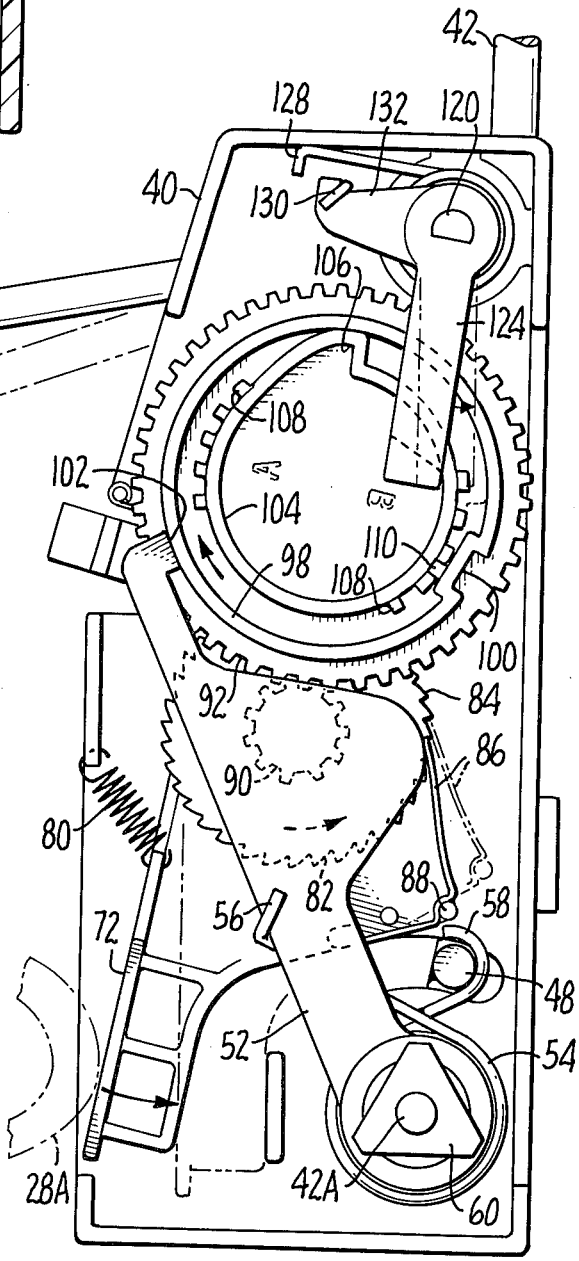
FIG. 7 is a side, sectional view illustrating operational details of the device and in particular details of the transfer means of the device.

Pin-mounted in the central aperture of gear 92 and surrounded by cam element 98 is a second cam element 104 which, as may best be seen with reference to FIGS. 3, 7 and 8, is substantially circular in cross section except for a raised cam portion 106. A plurality of teeth 108 project from a portion of the second cam element. It will be appreciated that teeth 108 cooperating with tooth 110 projecting inwardly from the depressed portion 100 of cam element 98 enable the second cam element 104 to be selectively fixedly positioned in a variety of relative positions with respect to cam element 98 and gear 92. The purpose of this adjustment feature will be brought out below when operation of the present device is described.

Mounted in the aperture of a bearing 116 attached to support member 40 is a transfer arm 118. The end of transfer arm 118 that projects inwardly into the interior of support member 40 is machined away to provide a key portion 120 which is pressfit into a similarly shaped socket 122 of cam follower 124. A coil spring 126 is disposed over bearing 116 and between the outer wall of support member 40 and cam follower 124. As may best be seen with reference to FIGS. 3 and 7, one leg 128 of the spring bears against the upper portion of support member 40 while the other leg 130 thereof is in engagement with a projecting portion 132 of cam follower 124. The coil spring 126 being maintained in tension thus tends to urge cam follower 124 and thus transfer arm 118 in a counterclockwise direction as viewed in FIGS. 3, 7 and 8. The lower portion 134 of cam follower 124 is bent inwardly so that it is adapted to slide in engagement with the inner cam surface of second cam element 104. Such engagement is maintained by virtue of the tension of spring 126 as well as by the weight of the outer extremity of transfer arm 118.

Referring now to FIGS. 1 and 7, it will be seen that transfer arm 118 projects forwardly within housing 10 from support member 40 to a position above the nip formed by rollers 12 and 14. The transfer arm is then bent at right angles so that a substantial portion of the arm overlies the nip. Attached to the portion of the arm overlying the nip is a tucker blade 138 formed of plastic or the like which is preferably rotatably mounted on the transfer arm 118. At the extreme outer end of transfer arm 118 is a freely rotatably mounted roller 140 of any desirable material.

Figure 9:
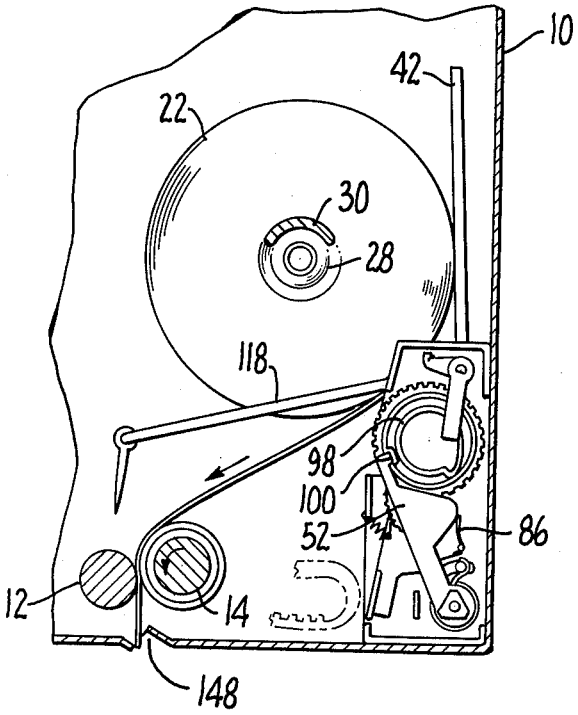
FIGS. 9, 10, 11 and 12 are partial sectional side views illustrating the relative positions assumed by various operating components of the device of the present invention during various stages of the operation thereof.

The operation of the aforedescribed mechanism will now be set forth. FIGS. 3 and 9 should be referred to for the initial stage of operation of the disclosed device. Placement of roll of toweling 22 into position on its end bearing members including bearing member 30 results in the displacement of sensing arm 42 to a substantially vertical position as shown in the two referenced figures. As previously mentioned, sensing arm 42 is continuously urged in a counterclockwise direction against the periphery of roll of toweling 22 under the tensioning of spring 54. Spring 54 also urges follower member 52 into engagement with cam element 98 with the upper reduced portion of follower member 52 being seated in depression 100. Follower member 52 has a bent-over central portion 144 which when the follower member is seated in depression 100 pushes spring steel pawl 86 to the right as shown in FIG. 3 so that the pawl is out of engagement with ratchet 82.

Figure 10:
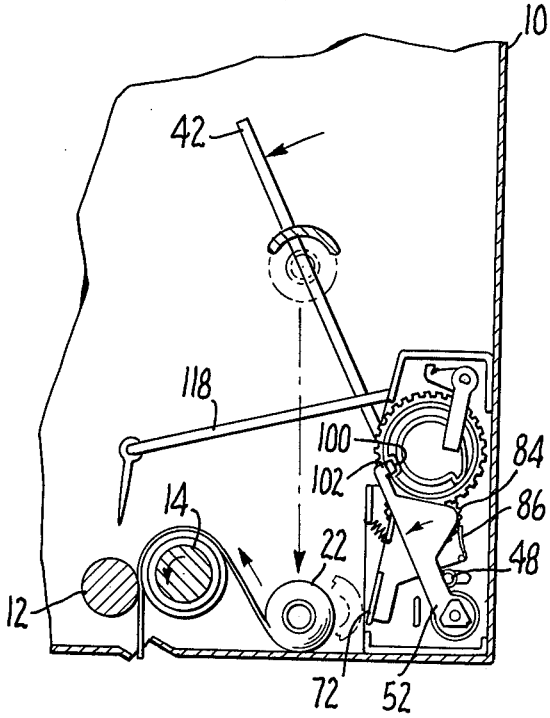

As the roll 22 decreases in size, sensing arm 42 moves forward within housing 10, i.e. in a counterclockwise direction as shown in FIGS. 3 and 9, the sensing arm maintaining contact with the rear surface of the roll as the sheet material is dispensed therefrom through an exit slit 148 formed in the bottom of housing 10 below the nip defined by rollers 12 and 14. When bearing wall 28 of the roll disappears due to dispensing of the sheet material, the remaining roll, commonly referred to as a stub roll, will fall from bearing member 30 and its opposed companion bearing member to the bottom of housing 10 as shown in FIG. 10. As the roll 22 falls, the weight of the sensing arm 42 and the tensioning of spring 126 will cause the sensing arm to rotate forward and downward to the position illustrated in phantom in FIG. 3 and in solid line in FIG. 10.

Such action results in activator pin 48 bearing against follower member 52 and urging same in a counterclockwise direction and the upper portion 102 thereof out of depression 100. The same motion moves bent-over central portion 144 of follower member 52 out of engagement with spring steel pawl 86 so that the pawl engages ratchet 82. After the engagement has occurred, counterclockwise movement of trigger element 72 will cause the pawl to advance the ratchet through engagement with teeth 84. It will be appreciated that slot 76 and boss 78 cooperate to limit the extent of movement of trigger element 72 so that the ratchet will be advanced one tooth per depression of the trigger element.

Depression of the trigger element 72, i.e. counterclockwise movement, is resisted due to the tensioning of spring 80 connected to the trigger element as has been previously described. Actual depression of the trigger element is effected by engagement thereof with a portion of the mechanism which is employed to translate the lineal motion of handle 18 into rotational motion of rollers 12 and 14 to dispense incremental, substantially uniform lengths of toweling upon depression of the handle 18 by the operator. As mentioned above, the precise mechanism employed to rotate rollers 12 and 14 is not important, however, one suitable mechanism is illustrated in the aforereferenced U.S. Pat. No. 3,606,125. With reference to that patent, and in particular to FIG. 9 thereof, a motion transfer means (identified in that patent by reference numeral 28) moves rearwardly within the dispenser housing upon manual depression of the handle. Such motion transfer means, therefore, represents an ideal means for translating movement of the handle 18 into depression, i.e. counterclockwise movement, of trigger element 72. A portion of the motion transfer means of U.S. Pat. No. 3,606,125 is shown in FIGS. 1, 3 and 7 in phantom and is identified by reference numberal 28A. It will be appreciated that movement of element 28A towards the right as viewed in these figures due to the depression of handle 18 will cause same to engage trigger element 72 to move it in a counterclockwise direction and thus cause ratchet 82 to be advanced to the extent of one tooth per complete depression of the handle. The ratchet is prevented from moving clockwise as shown in FIG. 3 due to engagement by a spring steel stop element 152 secured to support member 40. The spring steel stop element may best be seen with reference to FIG. 8.

Figure 11:
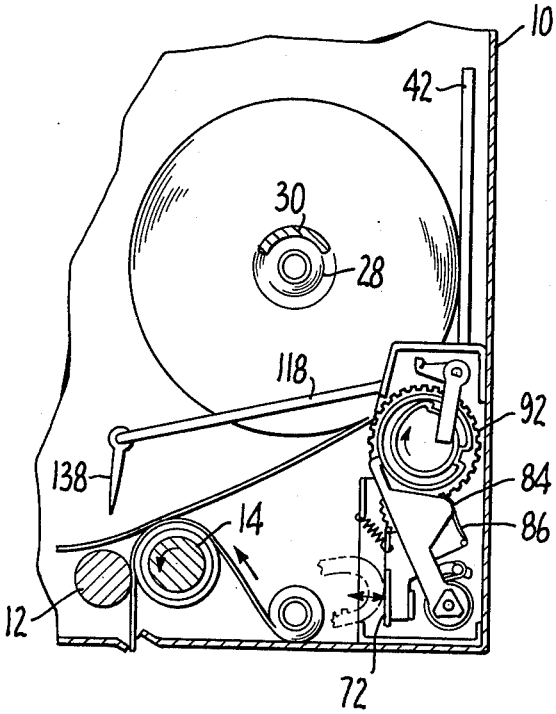

The stub roll which has automatically fallen to the bottom of the housing 10 will continue to have toweling removed therefrom by the rollers 12 and 14 upon depression of handle 18. It is, however, required that an attendant install a reserve roll of paper on bearing member 30 and its companion bearing member at some time before the stub roll is completely exhausted. Otherwise, of course, no toweling will be dispensed at all upon exhaustion of the stub roll. When a reserve roll is loaded, sensing arm 42 is again pushed toward the rear of the housing 10 (see FIG. 11) and follower member 52 is urged by spring 54 into engagement with the smooth circular cam surface of cam element 98 since activator pin 48 no longer serves to block such engagement. This action will have had no effect whatsoever on trigger element 72 which will continue to advance the ratchet each time handle 18 is depressed. After a certain predetermined number of strokes, second cam element 104 will arrive at a position whereat cam portion 106 will be in registry with lower portion 134 of cam follower 124. Under urging of spring 126 cam follower portion 134 will enter into the internal pocket or depression formed by raised cam portion 106. When the pocket and portion 134 are in alignment transfer arm 118 and tucker blade 138 will fall downwardly under their combined weights and under the urging of spring 126. The tucker blade then moves between the feed rollers 12 and 14, taking with it the reserve roll sheet which was placed by the attendant over the feed rolls of the dispenser when the reserve roll was positioned within the housing. When transfer arm 118 and tucker blade 138 move downwardly, roller 140 near the end of the transfer arm contacts a surface of one of the feed rolls thereby preventing the tucker blade from dropping so far into the nip formed by the rollers that it interferes with their proper operation and increases the force necessary to drive them. Due to the fact that the tucker blade is rotatably mounted on the transfer arm, the blade "seeks" the nip point. Slight differences in juxtaposition of the tucker blade with the rollers may occur due to production tolerances.

Figure 12:
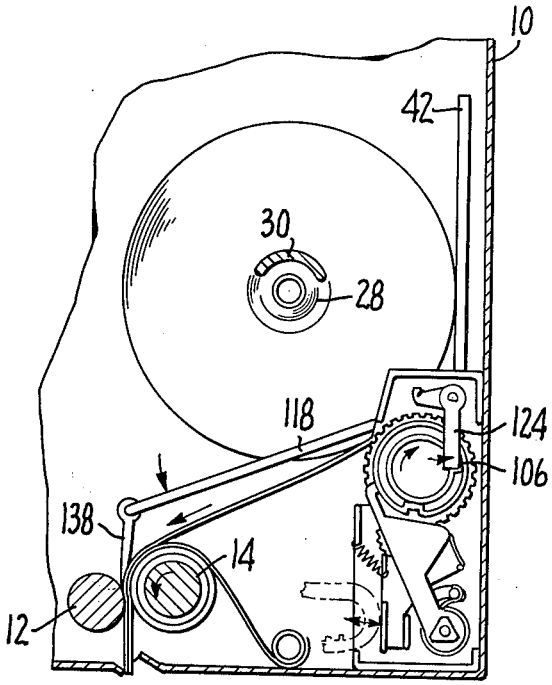

It will be obvious from the foregoing that the point of operation at which the transfer arm and tucker blade drop down is determined by the location of the depression formed by portion 106 of second cam element 104. One may wish to vary this location depending upon the basis weight of toweling used, thickness thereof and other factors that may vary and this may be readily done by changing the teeth 108 with which tooth 110 on cam element 98 is engaged. Changing the size of the bearing receptacle 26 on toweling roll 22 will also necessitate such a change if one is to be assured that the reserve roll commences feeding at the time the stub roll sheet material is exhausted. FIG. 12 shows the stage of operation of the present device at which the transfer arm and tucker blade move downwardly to initiate feeding of the reserve roll.

The next few strokes of handle 18 cause cam follower 124 to move in a clockwise direction, i.e. lower portion 134 thereof is cammed to the left. This action moves the tucker blade 138 upwardly to a position out of contact with the toweling which is of course now being fed through the nip defined by rollers 12 and 14. Gears and cams will continue to rotate with each lever stroke until depression 100 becomes aligned with the upper end 102 of follower member 52. Since follower member 52 is connected by spring 54 to activator pin 48 projecting from sensing arm 42 and the sensing arm has now been displaced to a generally vertical condition, the reduced end portion 102 of follower member 52 will enter into depression 100 of cam element 98. The same movement causes portion 144 of follower member 52 to displace the upstanding leg of pawl 86 to the right to disengage same from the ratchet. Thus, additional manipulation of handle 18 and the consequent stroking of trigger element 72 will not cause further advancement of ratchet 82 until the reserve dispensing roll becomes small enough to fall off the support, initiating another cycle of the transfer mechanism.

FIG. 13 illustrates an alternative form of follower member - cam element combination that may be employed, these parts being identified by reference numerals 52' and 98' respectively. Cam element 98' projects outwardly from gear 92 as was previously described with reference to cam element 98 above. Cam element 98' differs in configuration from cam element 98, however, in that it includes a ramp 160 leading to a bevelled notch 162. The upper portion of the ramp terminates about midway the bevelled surface 164 of the notch. Follower member 52' corresponds in all respects to follower member 52 except at the upper portion thereof, which is the only portion of the follower member illustrated in FIG. 13. The upper portion of follower member 52' is thinner, thus making it more flexible, and terminates with a projecting finger 166.

Although the device of the present invention is intended to function upon automatic displacement of the primary roll, it is possible that an attendant may open a cabinet, discover a roll is nearing the point where it would fall to the bottom of the cabinet, and would want to change the roll immediately rather than come back a short time later. The attendant will physically drop the roll into the bottom of the cabinet and install a new parent roll. When this is done, the sensing arm would move forward at the dropping of the stub roll and would be immediately returned to the back of the cabinet by the installation of the full roll. The follower member 52 would drop out of the depression 100 in the cam element 98 when this occurred but because no paper was dispensed during the time it was disengaged from the cam it would immediately return to the depression 100 when the new roll was reinstalled; hence, the mechanism would not sense this exchange of paper and would continue "waiting" for a roll to drop, thus, an automatic transfer would not take place.

The arrangement of follower member 52' and cam element 98' will solve this problem. When the terminal end of follower member 52' is approached by notch 162, the finger 166, which rides over cam element 98' as the end of follower member 52' engages the circular cam surface thereof, will ride upwardly on ramp 160, causing the follower member to be sprung outward. When the notch 162 of the cam element 98' becomes aligned with the follower member 52', the end of the follower member is urged into the pocket by spring 54 just as it was in the design first described above. However, at this time, the follower member is displaced from its natural position by the ramp 160 just described. When the stub roll drops and the sensing arm comes forward, the follower member 52' comes out of the notch 162. At this time, the end of the finger 166 drops off the ramp 160 and the stresses in the material cause the follower member to return to its normal position. When the sensing arm 42 returns to the rear of the cabinet, the follower member approaches the external cam, the end of the finger 166 will now come in contact with the bottom of the notch 162, holding the follower member out at approximately the same position as before the follower member dropped into the pocket; hence the pawl 86 of the trigger element 72 will be able to contact the ratchet 82 and the mechanism will advance whenever paper is dispensed. Thus, an automatic transfer can be accomplished even tough no paper was dispensed during the time the sensing arm 42 was forward and the follower member 52' was out of engagement with the cam element 98'.

We claim:

1. A dispensing device for sequentially dispensing sheet material such as paper toweling from a primary roll and a reserve roll, said primary roll initially being rotatably mounted at a first location and adapted to be displaced therefrom to a second location, and including sheet material feed means for dispensing the sheet material from said device, the improvement comprising:

sensing means for sensing displacement of said primary roll from said first location, and transfer means in operative association with said sensing means and responsive to the sensing of the displacement of said primary roll from said first location by said sensing means to place sheet material from said reserve roll into operative engagement with said sheet material feed means after said primary roll is located at said second location, said transfer means including metering means for metering sheet material removed from said primary roll by said feed means after displacement of said primary roll from said first location has been sensed by said sensing means and said primary roll is at said second location, said transfer means being responsive to the metering of a length of sheet material having been removed from said primary roll before placing the sheet material from said reserve roll into operative engagement with said sheet material feed means.

2. The dispensing device of claim 1 wherein said metering means includes adjustment means for selectively varying the length of sheet material that must be removed from said primary roll before the sheet material from said reserve roll is placed into operative engagement with said sheet material feed means.

3. The dispensing device of claim 1 additionally comprising manually operable means operatively associated with said sheet material feed means to dispense incremental substantially uniform lengths of sheet material upon manipulation of the manually operable means, and wherein said metering means comprises accumulator mechanism actuated by said manually operable means upon manipulation thereof to count the number of times the manually operable means is manipulated, said transfer means adapted to place the sheet material from the reserve roll into operative engagement with the sheet material feed means when a predetermined total number of incremental lengths of sheet material are dispensed.

* * * * *